US011117400B2

(12) United States Patent
Chang

(10) Patent No.: US 11,117,400 B2
(45) Date of Patent: Sep. 14, 2021

(54) PAPER PROCESSING DEVICE

(71) Applicant: PRIMAX ELECTRONICS LTD., Taipei (TW)

(72) Inventor: Yu-Lun Chang, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 31 days.

(21) Appl. No.: 16/736,229

(22) Filed: Jan. 7, 2020

(65) Prior Publication Data

US 2021/0138808 A1 May 13, 2021

(30) Foreign Application Priority Data

Nov. 8, 2019 (TW) ..... 108140696

(51) Int. Cl.

| | |
|---|---|
| ***B41J 13/10*** | (2006.01) |
| ***B41J 13/02*** | (2006.01) |
| ***B41J 13/00*** | (2006.01) |
| *B42C 1/12* | (2006.01) |
| *B41J 23/38* | (2006.01) |

(52) U.S. Cl.

CPC ..... *B41J 13/106* (2013.01); *B41J 13/0036* (2013.01); *B41J 13/02* (2013.01); *B41J 23/38* (2013.01); *B42C 1/12* (2013.01)

(58) Field of Classification Search

CPC ..... B41J 13/106; B41J 13/02; B41J 13/0036; B41J 23/38; B42C 1/12

See application file for complete search history.

(56) References Cited

U.S. PATENT DOCUMENTS 5,609,333 A * 3/1997 Mandel ..... B65H 39/11 270/58.09

* cited by examiner

*Primary Examiner* — Geoffrey S Mruk
(74) *Attorney, Agent, or Firm* — WPAT, PC

(57) ABSTRACT

A paper processing device includes a casing and a paper pressing mechanism. The casing includes a paper placement platform. The paper placement platform is extended externally from the casing so as to support the plural papers. The paper pressing mechanism includes a pressing bar, a driving mechanism and a linking mechanism. The pressing bar includes a pressing structure. The linking mechanism is connected between the driving mechanism and the pressing bar. While the linking mechanism is driven by the driving mechanism, the pressing bar is moved with the linking mechanism and rotated relative to the paper placement platform, so that the pressing structure is moved from an initial position to a target position. When the pressing structure is moved to the target position and contacted with the plural papers, a guiding channel is defined between the pressing structure and the paper placement platform.

7 Claims, 7 Drawing Sheets

PAPER PROCESSING DEVICE

FIELD OF THE INVENTION

The present invention relates to a paper processing device, and more particularly to a paper processing device with a paper pressing mechanism.

BACKGROUND OF THE INVENTION

Printing devices are essential information apparatuses in modern offices. For example, the printing devices include copiers, printers, scanners and office machines. Among these printing devices, printers are the most popular. Generally, when a printer is connected with a computer, the electronic file in the computer may be printed on a blank paper. In a case that the electronic file contains numerous data, the electronic file needs to be printed on at least two blank papers. For facilitating managing and filing the printed papers, the stack of printed papers are removed from the paper outlet tray of the printing device, and then aligned and stapled. Due to the stapling operation, these papers are combined together without being disorderly spread everywhere.

For most users, the printing operation of the printer has to be finished before the stapling operation is manually done. Since different electronic files to be printed have different data amounts, the time periods of waiting for the implementation of the printing operation are usually different. Under this circumstance, the user usually fails to efficiently manage the printed papers. For solving this problem, a paper processing device with a stapling function has been disclosed.

Generally, the conventional processing device comprises a paper placement platform. The multi-page document outputted from the printer or the scanner can be placed on the paper placement platform. After the multi-page document is placed on the paper placement platform, a paper-aligning action, a stapling action, a punching action or an associated action is performed to process the multi-page document. Then, the processed multi-page document is ejected out of the office machine. Consequently, the processed multi-page document can be taken by the user.

However, the conventional paper processing device still has some drawbacks. For example, while the multi-page document drops to the paper placement platform, the multi-page document is possibly uplifted or bent. While the plural pages of the multi-page document drop to the paper placement platform sequentially, the papers dropping to the paper placement platform at the later stage are influenced by the papers on the paper placement platform. Under this circumstance, the plural multi-page document cannot be well ordered. For solving this drawback, the paper processing device is equipped with a paper pressing mechanism. While the multi-page document drops to the paper placement platform, the multi-page document is flattened by the paper pressing mechanism. Consequently, the multi-page document on the paper placement platform can be stacked orderly.

Generally, during the operation of the paper pressing mechanism, the multi-page document on the paper placement platform is pressed by the weight of the paper pressing mechanism. If the document has strong rigidity or high curliness, the document cannot be smoothly flattened by the weight of the paper pressing mechanism. Consequently, the subsequent process of stapling the document is adversely affected.

Therefore, there is a need of providing an improved paper processing device in order to overcome the above drawbacks.

SUMMARY OF THE INVENTION

An object of the present invention provides a paper processing device. The paper pressing mechanism comprises the pressing bar, the driving mechanism and the linking mechanism. By the driving mechanism and the linking mechanism, the pressing bar is rotated relative to the paper placement platform. Consequently, the papers on a paper placement platform are flattened. Moreover, a guiding channel is defined by the pressing bar and the paper placement platform. After the papers are transferred to a stapling mechanism through the guiding channel, the papers are stapled by the stapling mechanism.

The other objects and advantages of the present invention will be understood from the disclosed technical features.

In accordance with an aspect of the present invention, a paper processing device is provided for processing plural papers from a printing device. The paper processing device includes a casing and a paper pressing mechanism. The casing includes a paper placement platform. The paper placement platform is extended externally from the casing so as to support the plural papers. The paper pressing mechanism includes a pressing bar, a driving mechanism and a linking mechanism. The pressing bar is located over the paper placement platform, and includes a pressing structure. The driving mechanism is installed on the casing. The linking mechanism is connected between the driving mechanism and the pressing bar. While the linking mechanism is driven by the driving mechanism, the pressing bar is moved with the linking mechanism and rotated relative to the paper placement platform, so that the pressing structure is moved from an initial position to a target position. When the pressing structure is moved to the target position and contacted with the plural papers, a guiding channel is defined between the pressing structure and the paper placement platform.

In an embodiment, the driving mechanism includes a solenoid valve body and an electromagnetic push rod. The electromagnetic push rod is installed in the solenoid valve body. A portion of the electromagnetic push rod is exposed outside the solenoid valve body.

In an embodiment, the casing further includes a positioning shaft and a fixing end. The linking mechanism includes a first elastic linkage, a second elastic linkage and a first transmission part. The first transmission part includes a first coupling hole, a second coupling hole and a pivotal part. The first coupling hole and the second coupling hole are opposed to each other. The pivotal part is arranged between the first coupling hole and the second coupling hole. The first elastic linkage is connected between the electromagnetic push rod and the first coupling hole of the first transmission part. The second elastic linkage is connected between the fixing end of the casing and the second coupling hole of the first transmission part. The positioning shaft is pivotally coupled to the pivotal part of the first transmission part.

In an embodiment, the pressing bar further includes a second transmission part, and the second transmission part is contacted with the first transmission part of the linking mechanism. When the solenoid valve body is in an electrically-conducted state, the solenoid valve body drives a movement of the electromagnetic push rod in a first direction, and the movement of the electromagnetic push rod in the first direction allows the first elastic linkage and the second elastic linkage to be stretched. In response to an elastic restoring force of the stretched first elastic linkage, the first transmission part is rotated in a first rotation direction by using the positioning shaft as a fulcrum. As the first transmission part is rotated in the first rotation direction, the second transmission part is rotated in a second rotation direction opposite to the first rotation direction. As the second transmission part is rotated in the second rotation direction, the pressing bar is rotated in the second rotation direction, so that the pressing structure is moved to the target position.

Preferably, when the solenoid valve body is switched from the electrically-conducted state to a shut-off state, the electromagnetic push rod is moved in a second direction opposite to the first direction. While the electromagnetic push rod is moved in the second direction, the first elastic linkage is moved in the second direction. In response to a force of moving the first elastic linkage in the second direction and an elastic restoring force of the second elastic linkage, the first transmission part is rotated in the second rotation direction by using the positioning shaft as the fulcrum. As the first transmission part is rotated in the second rotation direction, the second transmission part is rotated in the first rotation direction. As the second transmission part is rotated in the first rotation direction, the pressing bar is rotated in the first rotation direction. Consequently, the pressing structure is returned to the initial position.

In an embodiment, the first transmission part includes plural first tooth structures, and the second transmission part includes plural second tooth structures. The plural first tooth structures and the plural second tooth structures are engaged with each other.

In an embodiment, the paper processing device further includes a transfer roller assembly, and the transfer roller assembly is installed on the casing and located over the paper placement platform. The transfer roller assembly includes a rotation shaft and plural rollers. The plural rollers are pivotally coupled to the rotation shaft. The pressing bar is pivotally coupled to the rotation shaft. When the pressing bar is moved with the linking mechanism, the pressing bar is rotated relative to the paper placement platform by using the rotation shaft as a fulcrum.

In an embodiment, the paper processing device further includes a stapling mechanism. The stapling mechanism is installed on the casing and located beside the paper placement platform. The plural papers on the paper placement platform are transferred to the stapling mechanism through the guiding channel and stapled by the stapling mechanism.

In an embodiment, the pressing structure of the pressing bar has a pressing surface facing the paper placement platform, and the pressing surface includes a flat segment and an inclined segment. The flat segment and the inclined segment are connected with each other. The flat segment is arranged near the stapling mechanism. The inclined segment is located away from the stapling mechanism. An equidistant channel is formed between the flat segment and the paper placement platform. The inclined segment is inclined in a direction away from the paper placement platform. A tapered non-equidistant channel is formed between the inclined segment and the paper placement platform. The guiding channel contains the equidistant channel and the non-equidistant channel.

From the above descriptions, the present invention provides the paper processing device with the paper pressing mechanism. By the paper pressing mechanism, the papers on the paper placement platform is flattened. The guiding channel is defined by the pressing bar and the paper placement platform. After the papers are introduced into the stapling mechanism smoothly through the guiding channel, the papers are stapled by the stapling mechanism. The paper pressing mechanism comprises the pressing bar, the driving mechanism and the linking mechanism. By the driving mechanism and the linking mechanism, the pressing bar is rotated relative to the paper placement platform. Consequently, even if the papers have strong rigidity or high curliness, the papers can be smoothly flattened for facilitating the subsequent stapling action of the papers. Moreover, since the papers are guided by the guiding channel between the pressing bar and the paper placement platform, the papers are not jammed in the path to the stapling mechanism. Due to the structural design of the paper processing device, the overall volume and the fabricating cost of the paper processing device are reduced.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
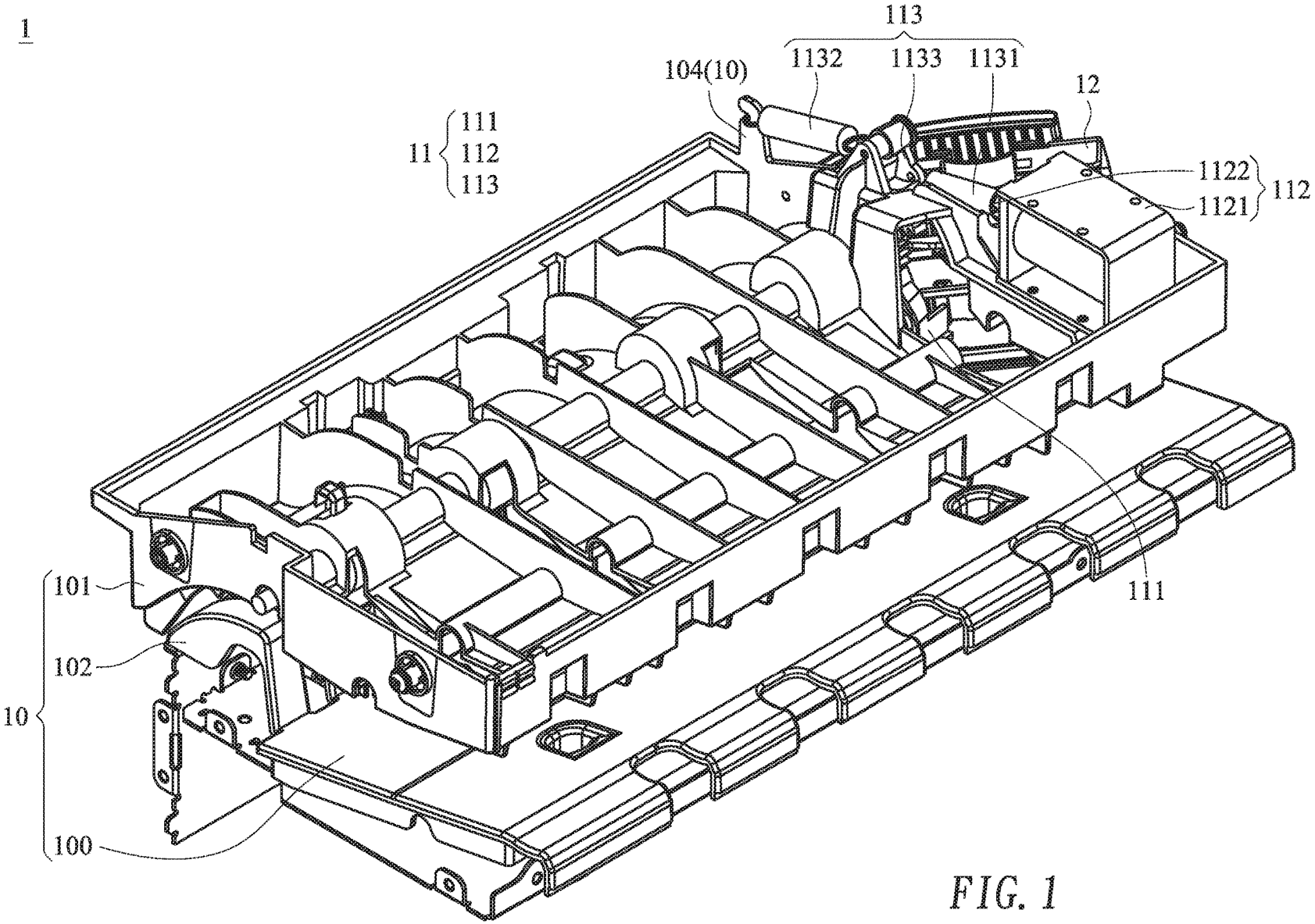
FIG. 1 is a schematic perspective view illustrating the appearance of a paper processing device according to an embodiment of the present invention.
Figure 2:
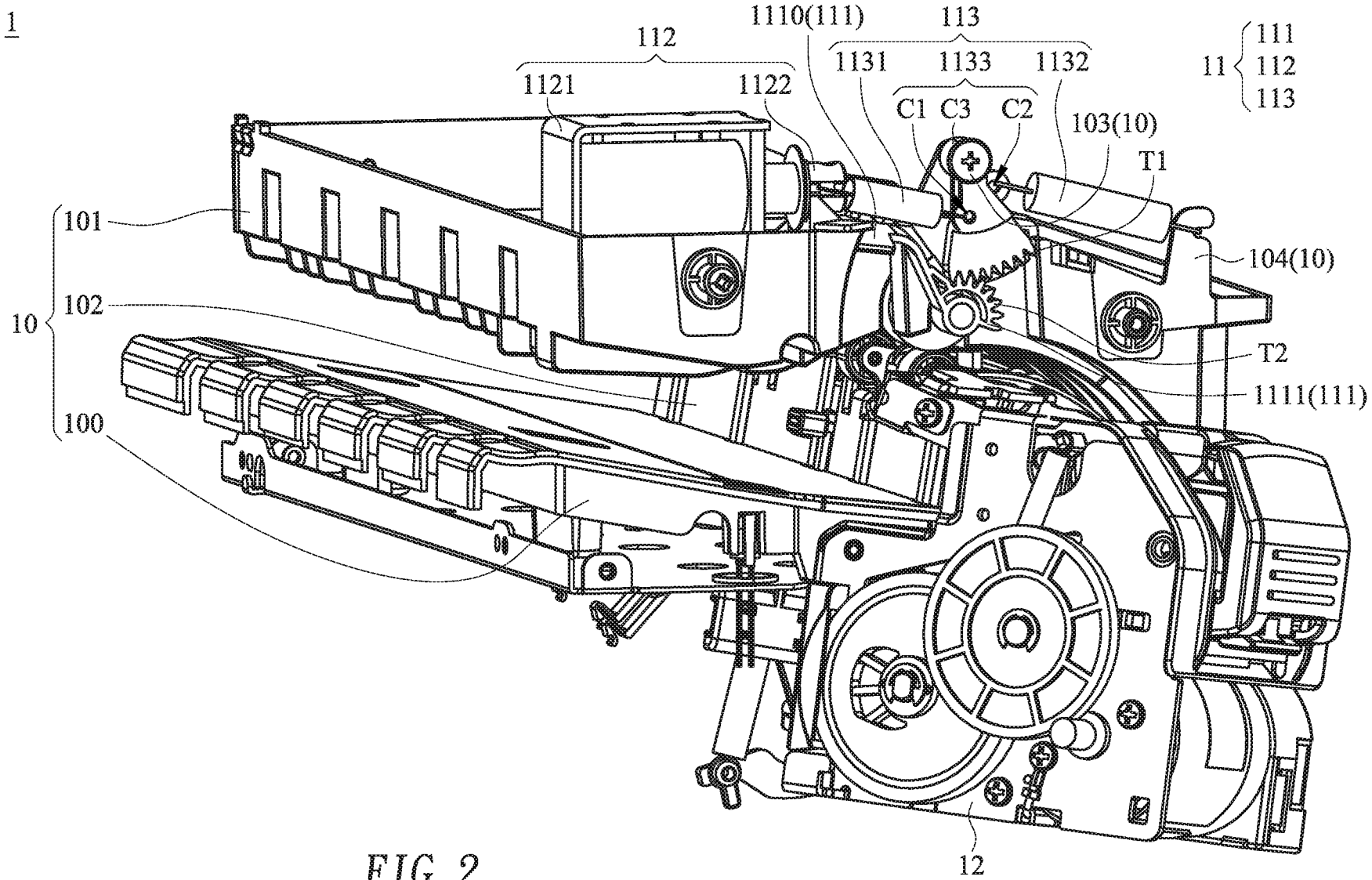
FIG. 2 is a schematic perspective view illustrating a portion of the paper processing device as shown in FIG. 1 and taken along the lateral viewpoint.

Please refer to FIGS. 1 and 2. FIG. 1 is a schematic perspective view illustrating the appearance of a paper processing device according to an embodiment of the present invention. FIG. 2 is a schematic perspective view illustrating a portion of the paper processing device as shown in FIG. 1 and taken along the lateral viewpoint. In an embodiment, the paper processing device 1 is installed over a printing device (not shown) or located at bilateral sides of the printing device. The paper processing device 1 used for processing plural papers that are transported from the printing device. For example, the paper processing device 1 can perform a stapling action or a punching action on the papers.

Please refer to FIGS. 1 and 2 again. In this embodiment, the paper processing device 1 comprises a casing 10 and a paper pressing mechanism 11. The casing 10 comprises a paper placement platform 100. The paper placement platform 100 is extended externally from the casing 10. The paper pressing mechanism 11 comprises a pressing bar 111, a driving mechanism 112 and a linking mechanism 113. The pressing bar 111 is located over the paper placement platform 100. Moreover, the pressing bar 111 comprises a pressing structure 1110. The driving mechanism 112 is installed on the casing 10. The linking mechanism 113 is arranged between the driving mechanism 112 and the pressing bar 111.

In this embodiment, the casing 10 comprises an upper part 101 and a lower part 102. The paper placement platform 100 is extended externally from the lower part 102 of the casing 10. The driving mechanism 112 and the linking mechanism 113 are installed on the upper part 101 of the casing 10. As the linking mechanism 113 is driven by the driving mechanism 112, the pressing bar 111 is moved with the linking mechanism 113. Consequently, the pressing bar 111 is rotated relative to the paper placement platform 100. In such way, the pressing structure 1110 of the pressing bar 111 is moved from an initial position to a target position. When the pressing structure 1110 is moved to the target position, the pressing structure 1110 is contacted with the papers on the paper placement platform 100. When the pressing structure 1110 is in the target position, a guiding channel is defined by the pressing structure 1110 and the paper placement platform 100. The operations of the paper pressing mechanism 11 will be described in more details later.

The structure of the paper processing device 1 will be illustrated in more details as follows.

Please refer to FIG. 2 again. The driving mechanism 112 comprises a solenoid valve body 1121 and an electromagnetic push rod 1122. The electromagnetic push rod 1122 is installed in the solenoid valve body 1121. A portion of the electromagnetic push rod 1122 is exposed outside the solenoid valve body 1121. In this embodiment, the driving mechanism 112 comprises the solenoid valve body 1121 and the electromagnetic push rod 1122. It is noted that the example of the driving mechanism 112 is not restricted. For example, in another embodiment, the driving mechanism 112 is a motor for driving the linking mechanism 113.

As shown in FIG. 2, the casing 10 further comprises a positioning shaft 103 and a fixing end 104. In this embodiment, the positioning shaft 103 and the fixing end 104 are installed on the upper part 101 of the casing 10. Preferably but not exclusively, the positioning shaft 103 is fixed on the upper part 101 of the casing 10 through a screw. The linking mechanism 113 comprises a first elastic linkage 1131, a second elastic linkage 1132 and a first transmission part 1133. The first transmission part 1133 comprises a first coupling hole C1, a second coupling hole C2 and a pivotal part C3. The first coupling hole C1 and the second coupling hole C2 are opposed to each other. That is, the first coupling hole C1 and the second coupling hole C2 are located beside two opposite sides of the first transmission part 1133. The pivotal part C3 is arranged between the first coupling hole C1 and the second coupling hole C2. The first elastic linkage 1131 is connected between the electromagnetic push rod 1122 of the driving mechanism 112 (i.e., the portion of the electromagnetic push rod 1122 exposed outside the solenoid valve body 1121) and the first coupling hole C1 of the first transmission part 1133. The second elastic linkage 1132 is connected between the fixing end 104 of the casing 10 and the second coupling hole C2 of the first transmission part 1133. In addition, the positioning shaft 103 of the casing 10 is pivotally coupled to the pivotal part C3 of the first transmission part 1133.

As shown in FIG. 2, the pressing bar 111 further comprises a second transmission part 1111. The second transmission part 1111 and the pressing structure 1110 are located at two opposite sides of the pressing bar 111. Moreover, the second transmission part 1111 is contacted with the first transmission part 1133 of the linking mechanism 113. In this embodiment, the first transmission part 1133 comprises plural first tooth structures T1, and the second transmission part 1111 comprises plural second tooth structures T2. The first tooth structures T1 and the second tooth structures T2 are engaged with each other. It is noted that the examples of the first transmission part 1133 and the second transmission part 1111 are not restricted. For example, in another embodiment, the first transmission part 1133 and the second transmission part 1111 are cams or sliding grooves.

As shown in FIG. 2, the paper processing device 1 further comprises a stapling mechanism 12. The stapling mechanism 12 is installed on the casing 10 and located beside the paper placement platform 100. Moreover, the paper pressing mechanism 11 is arranged near the stapling mechanism 12. The papers on the paper placement platform 100 can be stapled by the stapling mechanism 12. The example of installing the stapling mechanism 12 beside the paper placement platform 100 is presented herein for purpose of illustration and description only. For example, in another embodiment, the paper processing device further comprises a punching mechanism beside the paper placement platform for performing a punching action. Alternatively, the paper processing device further comprises a mechanism with both of a stapling function and a punching function.

The operations of the paper processing device 1 will be illustrated in more details as follows.

Figure 3:
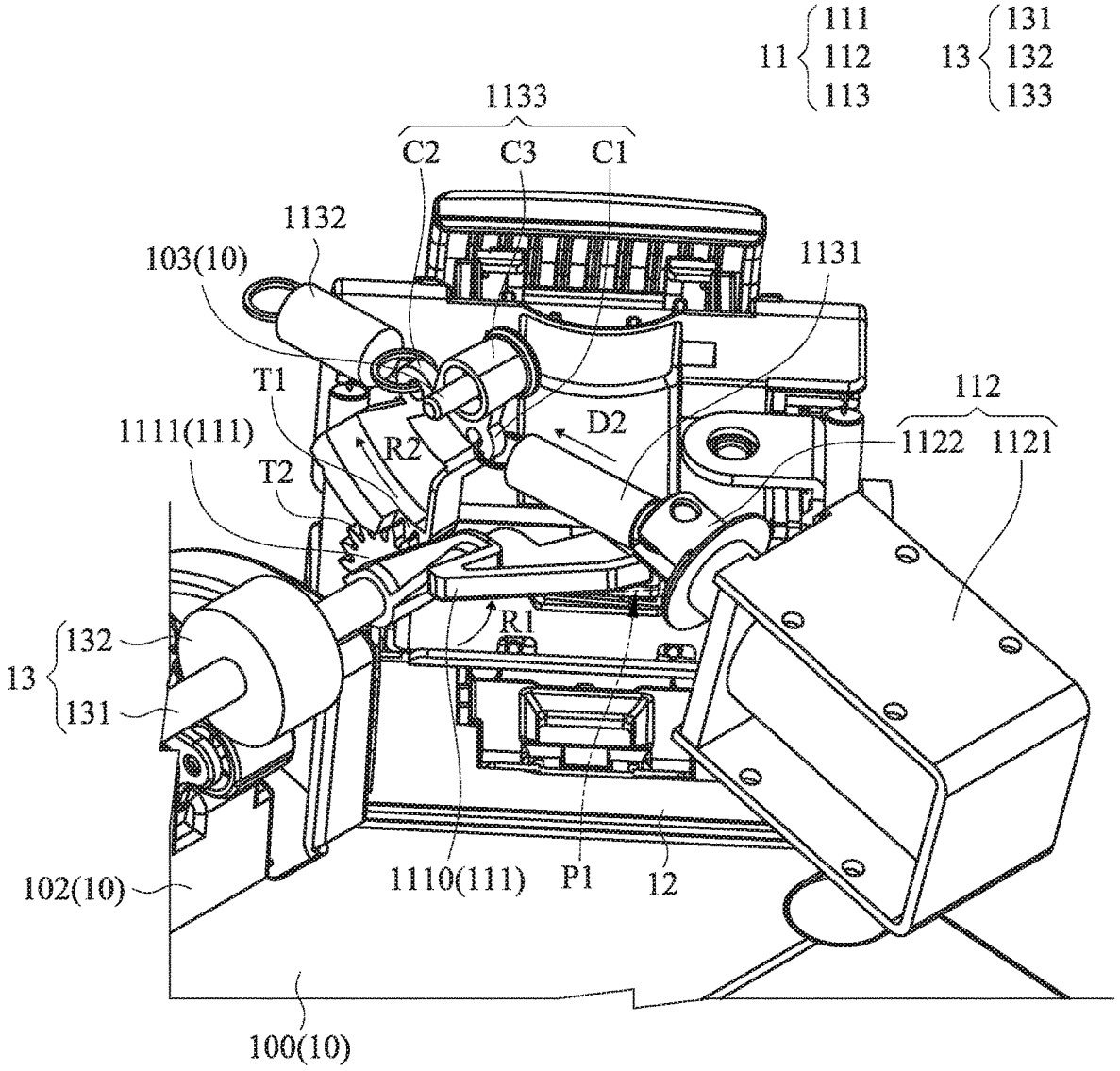
FIG. 3 is a schematic perspective view illustrating a portion of the paper pressing mechanism, in which the paper pressing mechanism is disabled.
Figure 4:
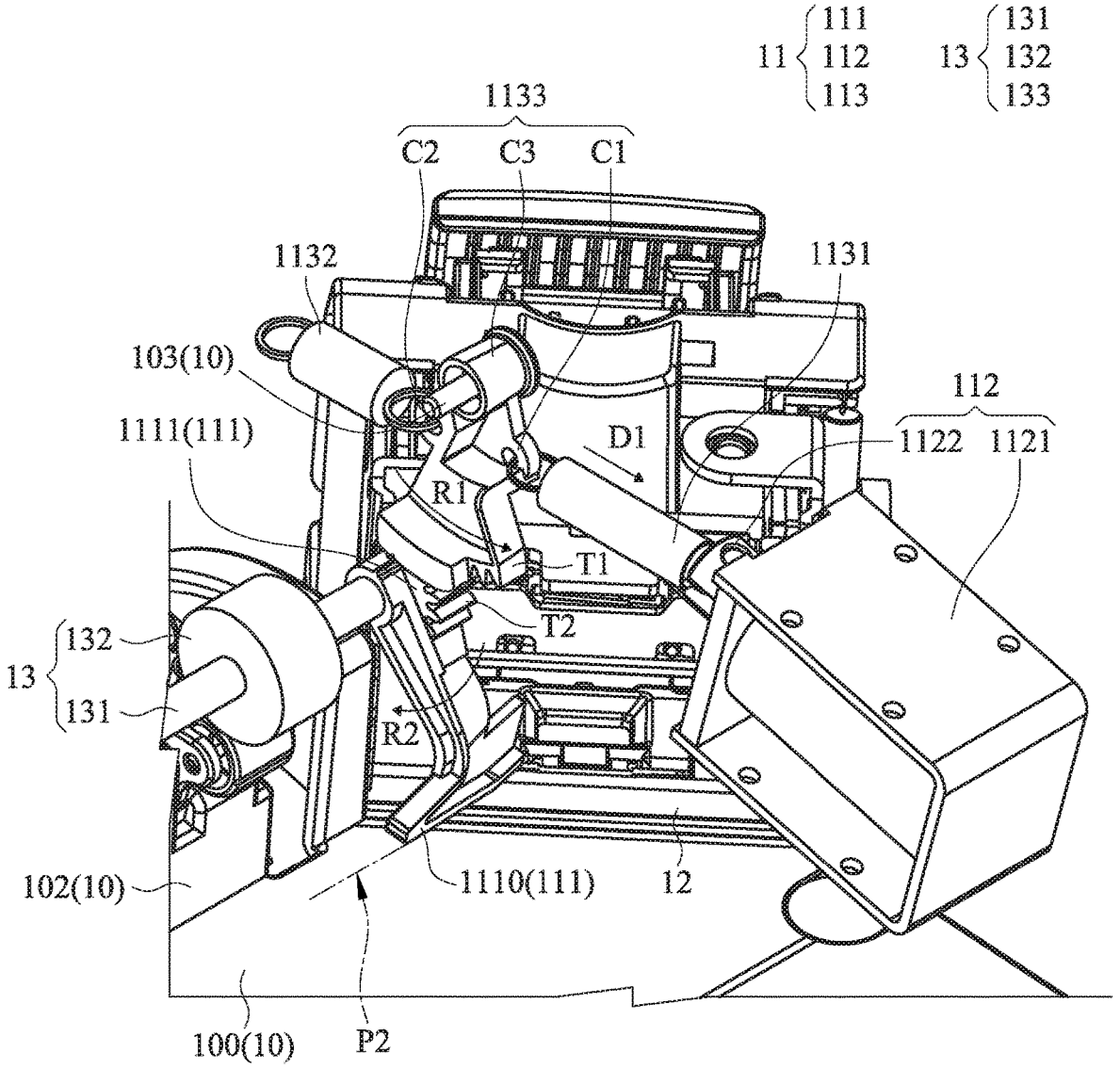
FIG. 4 is a schematic perspective view illustrating a portion of the paper pressing mechanism, in which the paper pressing mechanism is enabled.

Please refer to FIGS. 3 and 4. FIG. 3 is a schematic perspective view illustrating a portion of the paper pressing mechanism, in which the paper pressing mechanism is disabled. FIG. 4 is a schematic perspective view illustrating a portion of the paper pressing mechanism, in which the paper pressing mechanism is enabled. For clearly describing the actions of the paper pressing mechanism 11, the upper part 101 of the casing 10 is not shown in FIGS. 3 and 4.

As shown in FIG. 3, the paper processing device 1 is not enabled, and the pressing structure 1110 of the pressing bar 111 is in the initial position P1. In FIG. 4, the solenoid valve body 1121 is electrically conducted. Consequently, the solenoid valve body 1121 drives the movement of the electromagnetic push rod 1122 in a first direction D1. When the electromagnetic push rod 1122 is moved in the first direction D1, both of the first elastic linkage 1131 and the second elastic linkage 1132 are stretched. In response to the elastic restoring force of the stretched first elastic linkage 1131, the first transmission part 1133 is rotated relative to the positioning shaft 103 (i.e., a fulcrum) in a first rotation direction R1. As the first transmission part 1133 is rotated in the first rotation direction R1, the second transmission part 1111 is rotated in a second rotation direction R2. The second rotation direction R2 is opposite to the first rotation direction R1. As the second transmission part 1111 is rotated in the second rotation direction R2, the pressing bar 111 is rotated in the second rotation direction R2. Consequently, the pressing structure 1110 is moved to the target position P2.

When the solenoid valve body 1121 is switched from the electrically-conducted state of FIG. 4 to a shut-off state of FIG. 3, the electromagnetic push rod 1122 is moved in a second direction D2. The second direction D2 is opposite to the first direction D1. By the way, a spring (not shown) is sheathed around the electromagnetic push rod 1122. When the solenoid valve body 1121 is in the electrically-conducted state, the spring is compressed. When the solenoid valve body 1121 is switched from the electrically-conducted state to the shut-off state, the compressed spring is released. In response to the elastic restoring force of the spring, the electromagnetic push rod 1122 is moved in the second direction D2. While the electromagnetic push rod 1122 is moved in the second direction D2, the first elastic linkage 1131 is moved in the second direction D2. In response to the force of moving the first elastic linkage 1131 in the second direction D2 and the elastic restoring force of the second elastic linkage 1132, the first transmission part 1133 is rotated relative to the positioning shaft 103 (i.e., a fulcrum) in the second rotation direction R2. As the first transmission part 1133 is rotated in the second rotation direction R2, the second transmission part 1111 is rotated in the first rotation direction R1. As the second transmission part 1111 is rotated in the first rotation direction R1, the pressing bar 111 is rotated in the first rotation direction R1. Consequently, the pressing structure 1110 is returned to the initial position P1.

If the paper pressing mechanism 11 has a breakdown or a malfunction, the curled papers fed into the stapling mechanism 12 may adversely affect the stapling action of the stapling mechanism 12. For solving this problem, the paper pressing mechanism 11 further comprises a sensor (not shown) for sensing the action of the paper pressing mechanism 11. If the paper pressing mechanism 11 has a breakdown or a malfunction, the sensor issues a notification signal. In response to the notification signal, the paper pressing mechanism 11 stops sending the papers to the stapling mechanism 12.

Please refer to FIGS. 3 and 4. In this embodiment, the paper processing device 1 further comprises a transfer roller assembly 13. The transfer roller assembly 13 is installed on the casing 10 and located over the paper placement platform 100. Particularly, the transfer roller assembly 13 is installed on the lower part 102 of the casing 102. The transfer roller assembly 13 comprises a rotation shaft 131 and plural rollers 132. The plural rollers 132 are pivotally coupled to the rotation shaft 131. In this embodiment, the pressing bar 111 is pivotally coupled to the rotation shaft 131. When the pressing bar 111 is moved with the linking mechanism 113, the pressing bar 111 is rotated relative to the paper placement platform 100 by using the rotation shaft 131 as the fulcrum. It is noted that the installation position of the pressing bar 111 is not restricted. As long as the pressing bar 111 is rotatable relative to the paper placement platform 100, the installation position of the pressing bar 111 may be varied according to the practical requirements.

Figure 5:
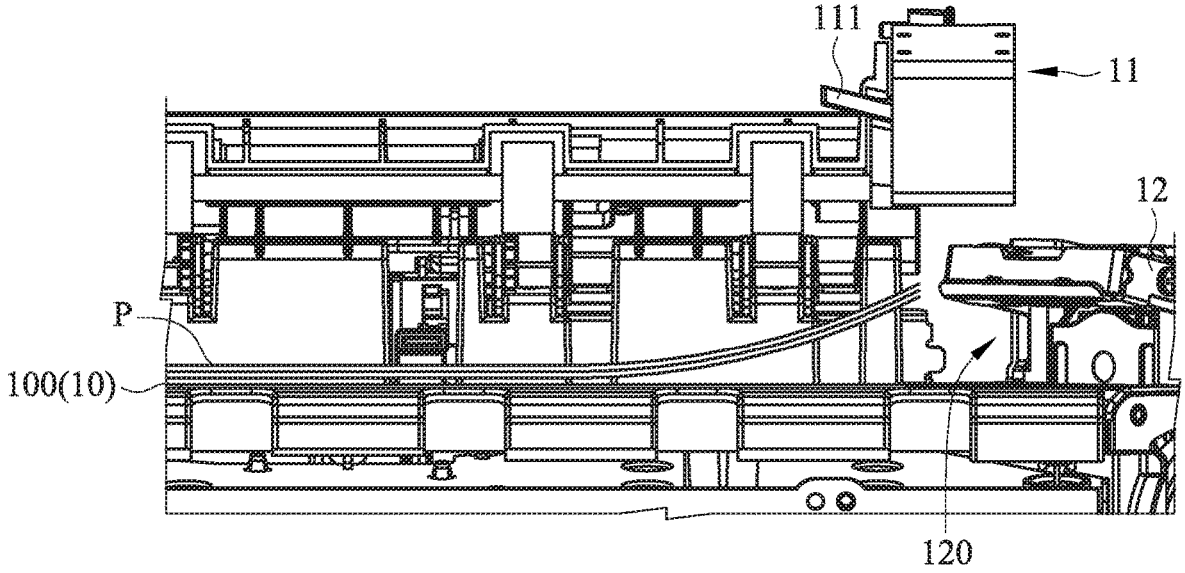
FIGS. 5, 6 and 7 are schematic cross-sectional views illustrating the actions of flattening and guiding the papers by the paper pressing mechanism of the present invention.
Figure 6:
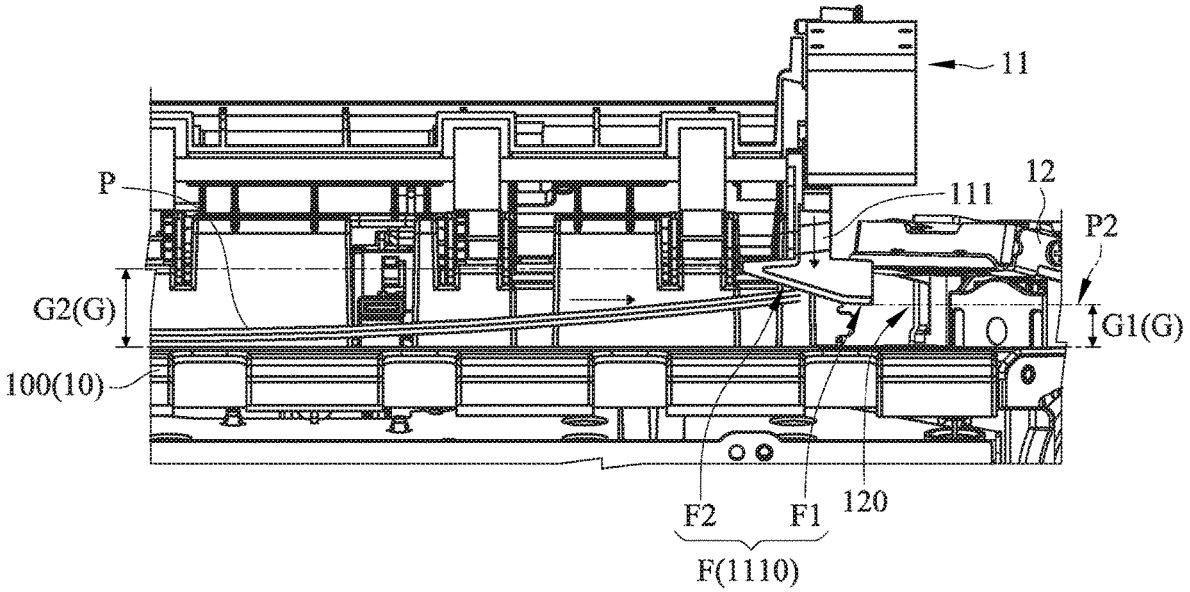
Figure 7:
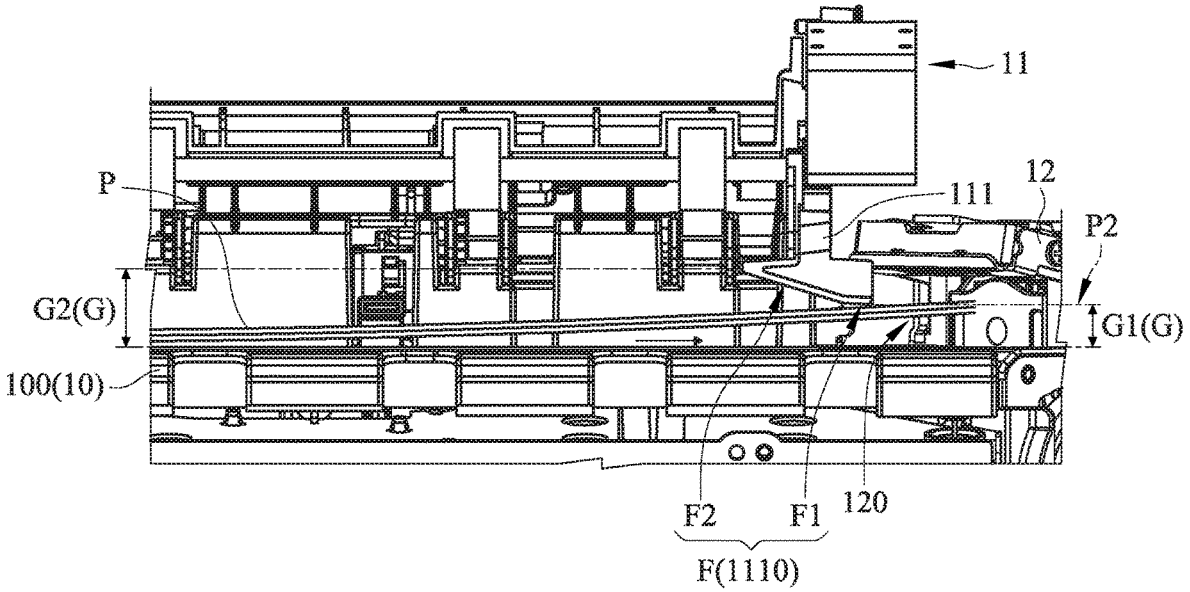

FIGS. 5, 6 and 7 are schematic cross-sectional views illustrating the actions of flattening and guiding the papers by the paper pressing mechanism of the present invention. Please refer to FIGS. 5, 6 and 7, and also refer to FIGS. 3 and 4. The stapling mechanism 12 comprises a paper inlet port 120. The paper pressing mechanism 11 is located near the paper inlet port 120. After the plural papers P are transferred from the printing device to the paper placement platform 100 of the paper processing device 1, the driving mechanism 112 of the paper pressing mechanism 11 drives the movement of the linking mechanism 113. As the linking mechanism 113 is driven by the driving mechanism 112, the pressing bar 111 is moved with the linking mechanism 113. Consequently, the pressing bar 111 is rotated relative to the paper placement platform 100. In such way, the pressing structure 1110 of the pressing bar 111 is moved to the target position P2. When the pressing structure 1110 of the pressing bar 111 is moved to the target position P2 and contacted with the plural papers P on the paper placement platform 100, the curled portions of the plural papers P are flattened by the pressing structure 1110 of the pressing bar 111 (see FIG. 6). When the pressing structure 1110 is in the target position P2, the guiding channel G between the pressing structure 1110 and the paper placement platform 100 is formed. Then, the plural papers P on the paper placement platform 100 are transferred through the guiding channel G and introduced into the stapling mechanism 12 through the paper inlet port 120 so as to be stapled (see FIG. 7).

Please refer to FIGS. 6 and 7 again. The pressing structure 1110 of the pressing bar 111 has a pressing surface F. The pressing surface F faces the paper placement platform 100. The pressing surface F comprises a flat segment F1 and an inclined segment F2, which are connected with each other. The flat segment F1 is arranged near the stapling mechanism 12. The inclined segment F2 is located away from the stapling mechanism 12. An equidistant channel G1 is formed between the flat segment F1 and the paper placement platform 100. The inclined segment F2 is inclined in the direction away from the paper placement platform 100. Consequently, a non-equidistant channel G2 is formed between the inclined segment F2 and the paper placement platform 100. The non-equidistant channel G2 is gradually decreased (i.e., tapered) in the direction close to the stapling mechanism 12. The guiding channel G contains the equidistant channel G1 and the non-equidistant channel G2. While the papers P on the paper placement platform 100 are transferred through the guiding channel G, these papers P are firstly transferred through the tapered non-equidistant channel G2 and the curled portions of these papers P are pressed by the inclined segment F2 of the pressing surface F. Consequently, the height of the curled portions of these papers P is gradually lowered. Then, these papers P are transferred through the equidistant channel G1. Then, these papers P are introduced into the stapling mechanism 12 through the paper inlet port 120 and stapled by the stapling mechanism 12. Especially, the vertical height of the flat segment F1 of the pressing surface F with respect to the paper placement platform 100 and the vertical height of any point of the inclined segment F2 with respect to the paper placement platform 100 are smaller than the width of the paper inlet port 120 of the stapling mechanism 12.

From the above descriptions, the present invention provides the paper processing device with the paper pressing mechanism. By the paper pressing mechanism, the papers on the paper placement platform is flattened. The guiding channel is defined by the pressing bar and the paper placement platform. After the papers are introduced into the stapling mechanism smoothly through the guiding channel, the papers are stapled by the stapling mechanism. The paper pressing mechanism comprises the pressing bar, the driving mechanism and the linking mechanism. By the driving mechanism and the linking mechanism, the pressing bar is rotated relative to the paper placement platform. Consequently, even if the papers have strong rigidity or high curliness, the papers can be smoothly flattened for facilitating the subsequent stapling action of the papers. Moreover, since the papers are guided by the guiding channel between the pressing bar and the paper placement platform, the papers are not jammed in the path to the stapling mechanism. Due to the structural design of the paper processing device, the overall volume and the fabricating cost of the paper processing device are reduced.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A paper processing device for processing plural papers from a printing device, the paper processing device comprising:

a casing comprising a paper placement platform, a positioning shaft, and a fixing end, wherein the paper placement platform is extended externally from the casing so as to support the plural papers; and a paper pressing mechanism comprising:

a pressing bar located over the paper placement platform, and comprising a pressing structure;

a driving mechanism installed on the casing, comprising a solenoid valve body and an electromagnetic push rod, wherein the electromagnetic push rod is installed in the solenoid valve body, and a portion of the electromagnetic push rod is exposed outside the solenoid valve body; and a linking mechanism, connected between the driving mechanism and the pressing bar, comprising a first elastic linkage, a second elastic linkage, and a first transmission part, wherein while the linking mechanism is driven by the driving mechanism, the pressing bar is moved with the linking mechanism and rotated relative to the paper placement platform, so that the pressing structure is moved from an initial position to a target position, wherein when the pressing structure is moved to the target position and contacted with the plural papers, a guiding channel is defined between the pressing structure and the paper placement platform;

wherein the first transmission part comprises a first coupling hole, a second coupling hole, and a pivotal part, the first coupling hole and the second coupling hole are opposed to each other, the pivotal part is arranged between the first coupling hole and the second coupling hole, the first elastic linkage is connected between the electromagnetic push rod and the first coupling hole of the first transmission part, the second elastic linkage is connected between the fixing end of the casing and the second coupling hole of the first transmission part, and the positioning shaft is pivotally coupled to the pivotal part of the first transmission part.

2. The paper processing device according to claim 1, wherein the pressing bar further comprises a second transmission part, and the second transmission part is contacted with the first transmission part of the linking mechanism, wherein when the solenoid valve body is in an electrically-conducted state, the solenoid valve body drives a movement of the electromagnetic push rod in a first direction, and the movement of the electromagnetic push rod in the first direction allows the first elastic linkage and the second elastic linkage to be stretched, wherein in response to an elastic restoring force of the stretched first elastic linkage, the first transmission part is rotated in a first rotation direction by using the positioning shaft as a fulcrum, wherein as the first transmission part is rotated in the first rotation direction, the second transmission part is rotated in a second rotation direction opposite to the first rotation direction, wherein as the second transmission part is rotated in the second rotation direction, the pressing bar is rotated in the second rotation direction, so that the pressing structure is moved to the target position.

3. The paper processing device according to claim 2, wherein when the solenoid valve body is switched from the electrically-conducted state to a shut-off state, the electromagnetic push rod is moved in a second direction opposite to the first direction, wherein while the electromagnetic push rod is moved in the second direction, the first elastic linkage is moved in the second direction, wherein in response to a force of moving the first elastic linkage in the second direction and an elastic restoring force of the second elastic linkage, the first transmission part is rotated in the second rotation direction by using the positioning shaft as the fulcrum, wherein as the first transmission part is rotated in the second rotation direction, the second transmission part is rotated in the first rotation direction, wherein as the second transmission part is rotated in the first rotation direction, the pressing bar is rotated in the first rotation direction, so that the pressing structure is returned to the initial position.

4. The paper processing device according to claim 2, wherein the first transmission part comprises plural first tooth structures, and the second transmission part comprises plural second tooth structures, wherein the plural first tooth structures and the plural second tooth structures are engaged with each other.

5. The paper processing device according to claim 1, wherein the paper processing device further comprises a transfer roller assembly, and the transfer roller assembly is installed on the casing and located over the paper placement platform, wherein the transfer roller assembly comprises a rotation shaft and plural rollers, the plural rollers are pivotally coupled to the rotation shaft, and the pressing bar is pivotally coupled to the rotation shaft, wherein when the pressing bar is moved with the linking mechanism, the pressing bar is rotated relative to the paper placement platform by using the rotation shaft as a fulcrum.

6. The paper processing device according to claim 1, wherein the paper processing device further comprises a stapling mechanism, wherein the stapling mechanism is installed on the casing and located beside the paper placement platform, wherein the plural papers on the paper placement platform are transferred to the stapling mechanism through the guiding channel and stapled by the stapling mechanism.

7. The paper processing device according to claim 6, wherein the pressing structure of the pressing bar has a pressing surface facing the paper placement platform, and the pressing surface comprises a flat segment and an inclined segment, wherein the flat segment and the inclined segment are connected with each other, the flat segment is arranged near the stapling mechanism, the inclined segment is located away from the stapling mechanism, an equidistant channel is formed between the flat segment and the paper placement platform, the inclined segment is inclined in a direction away from the paper placement platform, a tapered non-equidistant channel is formed between the inclined segment and the paper placement platform, and the guiding channel contains the equidistant channel and the non-equidistant channel.

* * * * *